US011319668B2

(12) United States Patent
Gomi et al.

(10) Patent No.: US 11,319,668 B2
(45) Date of Patent: May 3, 2022

(54) SHEET MANUFACTURING APPARATUS

(71) Applicant: SEIKO EPSON CORPORATION, Tokyo (JP)

(72) Inventors: Katsuhito Gomi, Nagano (JP); Nobumasa Abe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 594 days.

(21) Appl. No.: 16/328,325

(22) PCT Filed: Aug. 8, 2017

(86) PCT No.: PCT/JP2017/028734
§ 371 (c)(1),
(2) Date: Feb. 26, 2019

(87) PCT Pub. No.: WO2018/043065
PCT Pub. Date: Mar. 8, 2018

(65) Prior Publication Data

US 2021/0277600 A1 Sep. 9, 2021

(30) Foreign Application Priority Data

Aug. 31, 2016 (JP) ..... JP2016-169127

(51) Int. Cl.
*D21F 1/00* (2006.01)
*D21B 1/12* (2006.01)

(52) U.S. Cl.
CPC ..... *D21F 1/00* (2013.01); *D21B 1/12* (2013.01)

(58) Field of Classification Search
USPC ..... 162/261
See application file for complete search history.

(56) References Cited

U.S. PATENT DOCUMENTS

| | | | | |
|---|---|---|---|---|
| 9,315,941 | B2 | 4/2016 | Gomi et al. | |
| 2015/0204015 | A1 | 7/2015 | Gomi et al. | |
| 2016/0106143 | A1 | 4/2016 | Mei et al. | |
| 2018/0305868 | A1* | 10/2018 | Kunugi | D21B 1/08 |
| 2018/0305869 | A1* | 10/2018 | Seki | D21B 1/325 |

FOREIGN PATENT DOCUMENTS

| | | | |
|---|---|---|---|
| CN | 103892440 | A | 7/2014 |
| JP | 2015-137437 | A | 7/2015 |

* cited by examiner

*Primary Examiner* — Mark Halpern
(74) *Attorney, Agent, or Firm* — Global IP Counselors, LLP

(57) ABSTRACT

The sheet manufacturing apparatus includes: a rough crushing unit that roughly crushes a raw material containing fibers; and a defibration unit that defibrates the roughly crushed raw material in a gas atmosphere. In addition, the sheet manufacturing apparatus includes: first and second web formers that accumulate defibrated substances obtained through a defibrating process and form webs; and a sheet former that forms a sheet of the second web. In addition, the sheet manufacturing apparatus includes: a vaporization-type humidifying unit that humidifies a space in which the raw material is roughly crushed by the rough crushing unit; and a mist-type humidifying unit that humidifies the webs that are formed by the first and second web formers.

10 Claims, 7 Drawing Sheets

SHEET MANUFACTURING APPARATUS

CROSS-REFERENCE TO RELATED APPLICATIONS

This application is a U.S. National stage application of International Patent Application No. PCT/JP2017/028734, filed on Aug. 8, 2017, which claims priority under 35 U.S.C. § 119(a) to Japanese Patent Application No. 2016-169127, filed in Japan on Aug. 31, 2016. The entire disclosure of Japanese Patent Application No. 2016-169127 is hereby incorporated herein by reference.

TECHNICAL FIELD

The present invention relates to a sheet manufacturing apparatus.

BACKGROUND ART

There is known a sheet manufacturing apparatus that is configured to include a defibration unit that defibrates a substance to be defibrated in an atmosphere, a mixer that mixes defibrated substance and an additive containing a resin in an atmosphere, a humidity control unit that controls humidity of a mixture, and a heating unit that heats the humidity-controlled mixture (for example, see Japanese Unexamined Patent Application Publication No. 2015-137437). In Japanese Unexamined Patent Application Publication No. 2015-137437, the humidity control of the mixture induces an efficient hydrogen bond between fibers of a sheet when the heating unit performs heating.

Incidentally, in a type of sheet manufacturing apparatus, there is a concern that fragmented raw materials such as defibrated substances will be attached to portions due to an influence of charging and, thus, will remain or a concern that the raw materials will be attached to each other. In order to avoid the remaining and attachment, it is conceivable to employ a method in which a humidity control unit in the related art humidifies the fragmented raw materials. However, in this case, there is a concern that condensation will occur or it is not possible to sufficiently suppress remaining and attachment.

SUMMARY

In this respect, an object of the present invention is to appropriately humidify both a raw material that is caused to remain or be attached due to an influence of charging and a web obtained by accumulating defibrated substances.

In order to achieve the object, a sheet manufacturing apparatus of the present invention includes: a rough crushing unit that roughly crushes a raw material containing fibers; a defibration unit that defibrates the raw material roughly crushed by the rough crushing unit, in a gas atmosphere; a web former that accumulates defibrated substances obtained through a defibrating process performed by the defibration unit and forms a web; a sheet former that forms a sheet of the web; a vaporization-type humidifier that humidifies a space in which the raw material is roughly crushed by the rough crushing unit; and a mist-type humidifier that humidifies the web that is formed by the web former.

According to the present invention, it is possible to humidify a space through which fragmented raw materials pass, by the vaporization-type humidifier, while an occurrence of condensation is suppressed, and it is possible to suppress remaining of the raw material or attachment of the raw materials to each other due to an influence of charging. In addition, it is possible to humidify the web obtained by the accumulation of the defibrated substances, by the mist-type humidifier, without depending on a saturated steam amount of air. Hence, it is possible to appropriately humidify both the raw materials that are caused to remain or be attached to each other due to the influence of charging and the web obtained by the accumulation of the defibrated substances.

In addition, in the present invention, the vaporization-type humidifier humidifies a space in which the defibrated substances are accumulated.

According to the present invention, it is possible to suppress remaining of the fragmented raw materials in a space of accumulation or attachment of the raw materials to each other due to the influence of charging.

In addition, in the present invention, the sheet manufacturing apparatus further includes: a separation unit that has a separation belt, on which the defibrated substances are accumulated, and separates matter to be removed, which is not used in the sheet, from the defibrated substances. The vaporization-type humidifier humidifies a space in which the defibrated substances drop to the separation belt so as to be accumulated. The mist-type humidifier humidifies accumulated substances accumulated on the separation belt.

According to the present invention, it is possible to suppress remaining or attachment of the raw materials to each other due to the influence of charging in the fragmented raw materials that configure the defibrated substances, and it is possible to perform humidification to the extent that the accumulated substances accumulated on the separation belt do not adhere to the separation belt.

In addition, in the present invention, the sheet manufacturing apparatus further includes: a dust collecting unit that traps the matter to be removed, which has been separated by the separation unit. Air having passed through the defibration unit, the separation unit, and the dust collecting unit, in this order, is introduced as humidifying target air to the vaporization-type humidifier.

According to the present invention, since the air that has passed through the defibration unit, the separation unit, and the dust collecting unit, in this order, is humidified by the vaporization-type humidifier so as to be supplied to a space in which the raw material positioned upstream is roughly crushed, it is possible to use the air that has been used in manufacture of the sheet so as to humidify spaces of portions.

In addition, in the present invention, the sheet manufacturing apparatus further includes: a division unit that divides the accumulated substances accumulated on the separation belt. The vaporization-type humidifier humidifies a space in which the division unit divides the accumulated substances.

According to the present invention, it is possible to suppress remaining of the accumulated substances or attachment of the accumulated substances to each other due to the influence of charging in the space in which the accumulated substances accumulated on the separation belt are divided.

In addition, in the present invention, the sheet manufacturing apparatus further includes: a mixer that mixes a resin and defibrated substances that configure a subdivided body divided by the division unit. The web former accumulates mixtures mixed by the mixer and forms a web.

According to the present invention, since it is possible to suppress remaining or attachment of the defibrated substances, it is possible to appropriately perform mixing with the resin, and it is possible to appropriately form the web with the mixed mixture.

In addition, in the present invention, the sheet manufacturing apparatus further includes: a cutter that cuts the sheet formed by the sheet former. The vaporization-type humidifier humidifies a space in which the web is conveyed from the web former and a space including the cutter.

According to the present invention, it is possible to suppress adhesion of the web, adhesion of the sheet to a cut piece, or the like.

In addition, in the present invention, the sheet manufacturing apparatus further includes: a water tank that stores water. Water is supplied from the water tank to the vaporization-type humidifier and the mist-type humidifier.

According to the present invention, it is possible to combine the tanks that supply water to the vaporization-type humidifier and the mist-type humidifier, and thus it is advantageous in a reduction in the number of components and a reduction in size of the sheet manufacturing apparatus.

In addition, in the present invention, the sheet manufacturing apparatus further includes: a control unit that controls water supply to the vaporization-type humidifier and the mist-type humidifier. The control unit controls, as a water supply control, water supply to the water tank at a time of starting up and water supply to each humidifier from the water tank such that an amount of water equal to or larger than a predetermined amount is stored in the vaporization-type humidifier and the mist-type humidifier in a time from the starting up to an operation stop.

According to the present invention, control by the control unit enables water to be supplied to the water tank at the time of starting up and the humidifiers to continue humidification by using water supplied at the time of starting up.

In addition, in the present invention, the control unit controls, as a water discharge control at a time of an apparatus stop, water discharge to the water tank from the vaporization-type humidifier and the mist-type humidifier and water discharge from the water tank.

According to the present invention, the control by the control unit enables water to be discharged to the water tank from the humidifiers and water to be discharged from the water tank at the time of apparatus stop.

DESCRIPTION OF EMBODIMENTS

Hereinafter, a preferred embodiment of the present invention will be described in detail with reference to the drawings. The embodiments to be described below do not limit content of the present invention described in CLAIMS. In addition, the entire configuration to be described below is not limited as an essential configurational requirement of the present invention.

Figure 1:
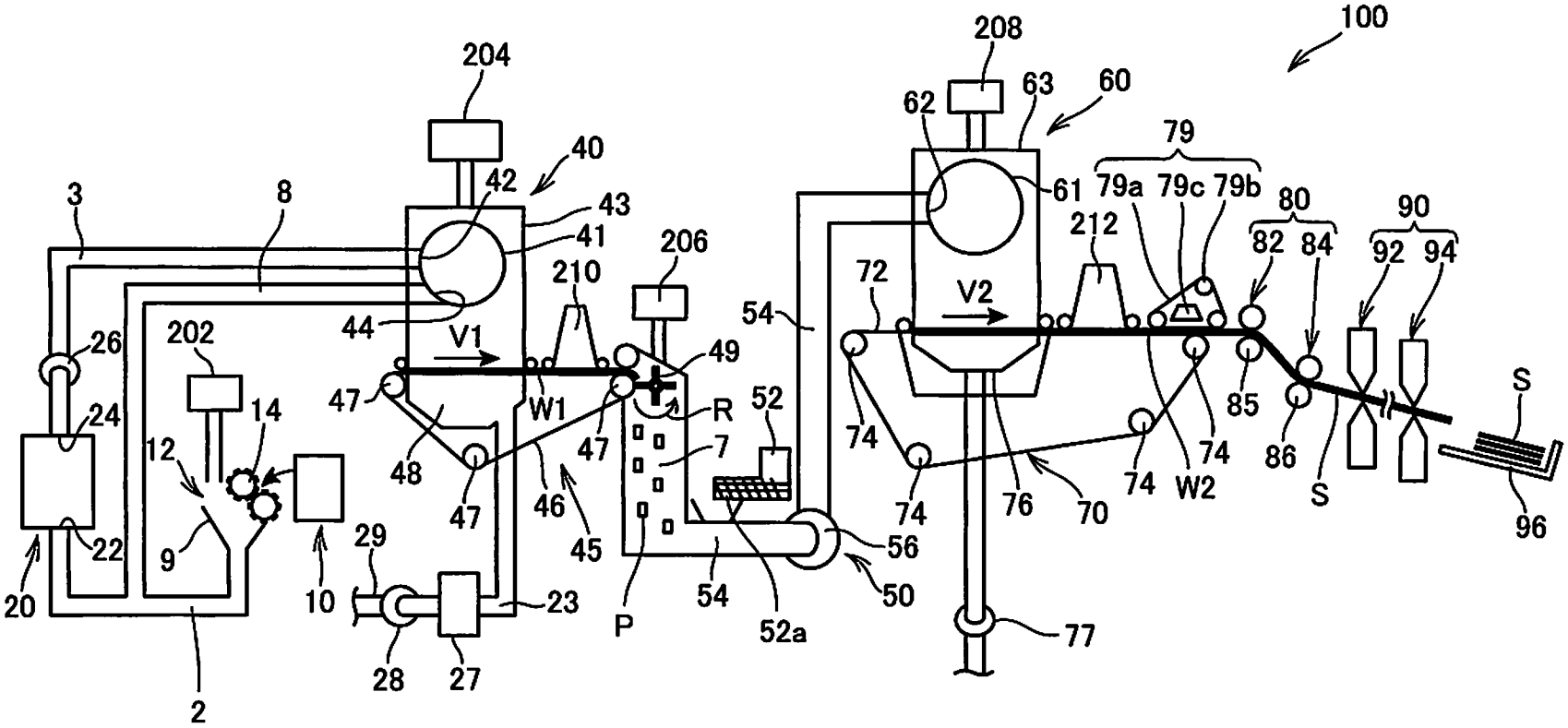
FIG. 1 is a schematic view showing a configuration of a sheet manufacturing apparatus according to an embodiment of the present invention.

FIG. 1 is a schematic view showing a configuration of a sheet manufacturing apparatus 100 according to an embodiment.

For example, the sheet manufacturing apparatus 100 described in the embodiment is an apparatus that is suitable for defibrating used waste paper such as confidential paper as a raw material in a dry method such that the paper is fiberized and, then, manufacturing new paper through pressurization, heating, and cutting. The fiberized raw material is mixed with various additives, and thereby bond strength or a whiteness level of a paper product may improve or a function of coloring, scenting, or flame resisting may be added, depending on a use. In addition, forming is performed by controlling density, a thickness, and a shape of paper, and thereby it is possible to manufacture paper having various thicknesses or sizes, depending on a use such as office paper having an A4 or A3 size or business card paper.

The sheet manufacturing apparatus 100 includes a supply unit 10, a rough crushing unit 12, a defibration unit 20, a sorting unit 40, a first web former 45, a rotary body 49, a mixer 50, an accumulation unit 60, a second web former 70, a conveying unit 79, a sheet former 80, and a cutter 90.

In addition, the sheet manufacturing apparatus 100 includes humidifying units 202, 204, 206, 208, 210, and 212 for the purpose of humidifying the raw material and/or a space through which the raw material moves.

In the embodiment, the humidifying units 202, 204, 206, and 208 indicates places to which air humidified by a vaporization-type humidifying unit 300 (FIG. 3) is supplied. In addition, the humidifying units 210 and 212 indicates places to which air humidified by a mist-type humidifying unit 400 (FIG. 5) is supplied.

The supply unit 10 supplies the raw material to the rough crushing unit 12. For example, any material may be used as the raw material of the sheet that is manufactured by the sheet manufacturing apparatus 100 as long as the material contains fiber, and examples of the raw material include paper, pulp, a pulp sheet, fabric containing nonwoven fabric, woven fabric, or the like. The embodiment employs a configuration in which the sheet manufacturing apparatus 100 uses used paper as the raw material. For example, the supply unit 10 can be configured to include a stacker, in which sheets of used paper overlap each other and are accumulated, and an automatic feed device that deliver the used paper to the rough crushing unit 12 from the stacker.

The rough crushing unit 12 has rough crushing blades 14 that cuts (roughly crushes) the raw material supplied by the supply unit 10 into rough-crushed pieces. The rough crushing blades 14 cut the raw material in a gas atmosphere such as in the atmosphere (in the air). For example, the rough crushing unit 12 includes a pair of rough crushing blades 14, which pinches and cuts the raw material, and a drive unit, which rotates the rough crushing blades 14, and the rough crushing unit can have the same configuration as that of a so-called shredder. The rough-crushed pieces may have any shape or size as long as the shape or size is suitable for a defibrating process in the defibration unit 20. For example, the rough crushing unit 12 cuts the raw material into paper pieces having a size equal to or smaller than 1 square centimeter to several square centimeters.

The rough crushing unit 12 has a chute (also referred to as hopper) 9 that receives the rough-crushed pieces which are cut by the rough crushing blades 14 and fall down. For example, the chute 9 has a tapered shape having a width that is gradually decreased, in a direction (proceeding direction) in which the rough-crushed pieces flow. Therefore, the chute 9 is capable of receiving a large amount of rough-crushed pieces. A pipe 2 that communicates with the defibration unit 20 is connected to the chute 9, and the pipe 2 forms a conveying channel for conveying the raw material (rough-crushed pieces) cut by the rough crushing blades 14 to the defibration unit 20. The rough-crushed pieces are gathered by the chute 9 and are conveyed (transported) to the defibration unit 20 through the pipe 2.

The humidifying unit 202 supplies humidified air to the chute 9 or the vicinity of the chute 9 included in the rough crushing unit 12. Consequently, it is possible to suppress a phenomenon in which rough-crushed materials cut by the rough crushing blades 14 are attached to an inner surface of the chute 9 or the pipe 2 due to static electricity. In addition, the rough-crushed materials cut by the rough crushing blades 14 are transported together with humidified air (having high humidity) to the defibration unit 20, and thus it is also possible to expect an effect of suppressing attachment of a defibrated substance to an inside of the defibration unit 20. In addition, the humidifying unit 202 may be configured to supply the humidified air to the rough crushing blades 14 so as to remove electricity from the raw material that is supplied by the supply unit 10. In addition, an ionizer together with the humidifying unit 202 may remove electricity.

The defibration unit 20 defibrates rough-crushed materials roughly crushed by the rough crushing unit 12. More specifically, the defibration unit 20 performs a defibrating process on the raw material (rough-crushed pieces) cut by the rough crushing unit 12 and generates the defibrated substance. Here, "to defibrate" means to unravel fibers one by one from the raw material (defibration target object) in which a plurality of fibers are bound. The defibration unit 20 also has a function of separating a substance such as a resin grain, ink, toner, or a bleeding preventive agent, which is attached to the raw material, from the fiber.

A substance having passed through the defibration unit 20 is referred to as the "defibrated substance". The "defibrated substance" includes a resin (resin for binding a plurality of fibers to each other) grain, a coloring agent such as ink or toner, or an additive such as a bleeding preventive agent or a paper strengthening agent, which is separated from the fiber when the fiber is unraveled, in addition to an unraveled defibrated fiber, in some cases. The unraveled defibrated substance which has a string shape or a ribbon shape. The unraveled defibrated substance may be present in a state in which the substance is not intertwined with another unraveled fiber (an independent state) or may be present in a state in which the substance is intertwined with another unraveled defibrated substance into a blocking shape (a state of forming a so-called "clump".

The defibration unit 20 performs dry defibration. Here, defibration performed through a process of defibration not in a liquid but in a gas such as in the atmosphere (in the air) is referred to as the dry defibration. In the embodiment, the defibration unit 20 is configured of an impeller mill. Specifically, the defibration unit 20 includes a rotor (not shown) that rotates at a high speed and a liner (not shown) that is positioned along an outer circumference of the rotor. The rough-crushed pieces that have been roughly crushed by the rough crushing unit 12 are sandwiched between the rotor and the liner of the defibration unit 20 so as to be defibrated. The defibration unit 20 generates an air current due to the rotation of the rotor. The air current enables the defibration unit 20 to suction the rough-crushed pieces which are the raw material from the pipe 2 and convey the defibrated substance to a discharge port 24. The defibrated substance is delivered to a pipe 3 from the discharge port 24 and is transported to the sorting unit 40 via the pipe 3.

In this manner, the defibrated substance that is generated in the defibration unit 20 is conveyed to the sorting unit 40 from the defibration unit 20 due to the air current that is generated by the defibration unit 20. Further, in the embodiment, the sheet manufacturing apparatus 100 includes a defibration unit blower 26 that is an air current generating device, and the defibrated substance is conveyed to the sorting unit 40 due to the air current generated by the defibration unit blower 26. The defibration unit blower 26 is attached to the pipe 3, suctions air together with the defibrated substance from the defibration unit 20, and performs blowing to the sorting unit 40.

The sorting unit 40 is provided with an introduction port 42 into which the defibrated substance defibrated by the defibration unit 20 flows along with the air current from the pipe 3. The sorting unit 40 sorts the defibrated substance introduced to the introduction port 42 depending on a length of fiber. To be more specific, the sorting unit 40 sorts a defibrated substance having a size equal to or smaller than a predetermined size into a first sorted substance, and a defibrated substance that is larger than the first sorted substance into a second sorted substance, of defibrated substances defibrated by the defibration unit 20. The first sorted substance includes a fiber, a grain, or the like, and a second sorted substance includes a long fiber, an incompletely defibrated piece (rough-crushed piece that is not sufficiently defibrated), a clump formed by clumping or entwining the defibrated fibers, or the like.

In the embodiment, the sorting unit 40 has a drum portion (sieve portion) 41 and a housing portion (cover portion) 43 that accommodates the drum portion 41.

The drum portion 41 is a cylinder sieve that is rotatably driven by a motor. The drum portion 41 has a net (a filter or a screen) and functions as a sieve. The drum portion 41 sorts into the first sorted substance smaller than a size of a mesh opening (opening) of the net and the second sorted substance larger than the mesh opening of the net, by meshes of the net. Examples of the net of the drum portion 41 include a wire mesh, expanded metal obtained by expanding a metal plate provided with cuts, or punched metal provided with holes formed in a metal plate by a press machine.

The defibrated substance introduced into the introduction port 42 is delivered along with the air current into the inside of the drum portion 41, and the first sorted substance falls downward from the mesh of the net of the drum portion 41 due to the rotation of the drum portion 41. The second sorted substance that cannot pass through the mesh of the net of the drum portion 41 flows to be guided to a discharge port 44 and is delivered to a pipe 8 along with the air current flowing to the drum portion 41 from the introduction port 42.

The pipe 8 connects the inside of the drum portion 41 to the pipe 2. The second sorted substance flowing through the pipe 8 flows to the pipe 2 along with the rough-crushed pieces that have been roughly crushed by the rough crushing unit 12 and is guided to an introduction port 22 of the defibration unit 20. Consequently, the second sorted substance returns to the defibration unit 20 and is obtained through a defibrating process.

In addition, the first sorted substances sorted by the drum portion 41 are dispersed in the air through the meshes of the net of the drum portion 41 and drop toward a mesh belt 46 of the first web former 45 that is positioned below the drum portion 41.

The first web former 45 includes the mesh belt 46 (separation belt), on which the defibrated substances are accumulated, and functions as a separation unit that separates matter to be removed, which is not used in a sheet S, from the defibrated substances. The first web former 45 further includes a stretching roller 47 and a suction unit (suction mechanism) 48. The mesh belt 46 is an endless belt, is suspended on three stretching rollers 47, and is conveyed along with motion of the stretching rollers 47 in a direction represented by an arrow in the drawing. The mesh belt 46 has a surface configured of a net in which openings having a predetermined size are arranged. Among the first sorted substances dropping from the sorting unit 40, fine particles having a size to the extent that it is possible to pass through the mesh of the net fall downward from the mesh belt 46, and fibers having a size to the extent that it is not possible to pass through the mesh of the net are accumulated on the mesh belt 46 and are conveyed along with the mesh belt 46 in an arrow direction. The fine particles falling from the mesh belt 46 include a relatively small substance or a substance having low density (such as a resin grain, a coloring agent, or an additive) of the defibrated substances and are substances to be removed, which are not used in manufacturing of a sheet S by the sheet manufacturing apparatus 100.

The mesh belt 46 moves at a constant speed V1 at the time of a normal operation of manufacturing the sheet S. Here, the time of the normal operation means a time of an operation excluding times of execution of start control and stop control of the sheet manufacturing apparatus 100 to be described below and, to be more specific, indicates while the sheet manufacturing apparatus 100 manufactures the sheet S having a desired quality.

Hence, the defibrated substances obtained through the defibrating process by the defibration unit 20 are sorted into the first sorted substances and the second sorted substances by the sorting unit 40, and the second sorted substances return to the defibration unit 20. In addition, the first web former 45 removes the substance to be removed from the first sorted substances. The rest of the first sorted substances obtained by removing the substance to be removed are materials suitable for manufacturing the sheet S, and the materials are accumulated on the mesh belt 46 so as to form a first web W1.

The suction unit 48 suctions air from below the mesh belt 46. The suction unit 48 is connected to a dust collecting unit 27 via a pipe 23. The dust collecting unit 27 separates the fine particles from the air current. A trapping blower 28 is installed downstream of the dust collecting unit 27, and the trapping blower 28 functions as a dust collecting suction unit that suctions air from the dust collecting unit 27. In addition, air discharged by the trapping blower 28 is discharged out of the sheet manufacturing apparatus 100 via a pipe 29.

In this configuration, air from the suction unit 48 is suctioned by the trapping blower 28 through the dust collecting unit 27. In the suction unit 48, the fine particles that pass through the meshes of the net of the mesh belt 46 are suctioned along with the air and are set to the dust collecting unit 27 through the pipe 23. The dust collecting unit 27 separates the fine particles having passed through the mesh belt 46 from the air current so as to accumulate the fine particles.

Hence, fibers obtained by removing the substances to be removed from the first sorted substance are accumulated on the mesh belt 46 such that the first web W1 is formed. The trapping blower 28 performs suction, thereby, promoting to form the first web W1 on the mesh belt 46, and the substances to be removed are rapidly removed.

The humidified air generated by the humidifying unit 204 is supplied to a space including the drum portion 41. It is possible to humidify the first sorted substance with the humidified air inside the sorting unit 40, and it is possible to weaken attachment of the first sorted substance to the mesh belt 46 due to an electrostatic force. Hence, it is possible to peel the first sorted substance from the mesh belt 46 easily, and it is possible to suppress attachment of the first sorted substance to an inner wall of the rotary body 49 or the housing portion 43 due to the electrostatic force. In addition, the suction unit 48 is capable of suctioning the substance to be removed efficiently.

In the sheet manufacturing apparatus 100, a configuration of sorting and separating the first sorted substance and the second sorted substance from each other is not limited to the sorting unit 40 that includes the drum portion 41. For example, a configuration may be employed, in which the defibrated substances obtained through the defibrating process by the defibration unit 20 are classified by a classifier. For example, it is possible to use a cyclone classifier, an elbow jet classifier, or an eddy classifier as the classifier. When the classifiers are used, it is possible to sort and separate the first sorted substance and the second sorted substance from each other. Further, the classifier can realize a configuration of separating and removing the substance to be removed, which includes a relatively small substance or a substance having low density (such as a resin grain, a coloring agent, or an additive) of the defibrated substances. For example, in the configuration, the fine particles contained in the first sorted substance may be removed from the first sorted substance by the classifier. In this case, it is possible to employ a configuration in which the second sorted substance returns to the defibration unit 20, for example, the substances to be removed are collected by the dust collecting unit 27, and the first sorted substance is sent to a pipe 54 without the substances to be removed.

In a conveyance route of the mesh belt 46, the humidifying unit 210 supplies air containing mist to a downstream side of the sorting unit 40. The mist which is fine particles of water generated by the humidifying unit 210 drops toward the first web W1 and supplies moisture to the first web W1. Consequently, it is possible to adjust an amount of moisture contained in the first web W1, and thus it is possible to suppress attachment or the like of a fiber to the mesh belt 46 due to the static electricity.

The sheet manufacturing apparatus 100 includes the rotary body 49 that functions as a division unit which divides the first web W1 accumulated on the mesh belt 46. The first web W1 is peeled from the mesh belt 46 and is cut and divided by the rotary body 49 at a position at which the mesh belt 46 is bent by the roller 47.

The first web W1 is a soft material having a web shape, which is formed of the accumulated fibers, and the rotary body 49 loosens the fibers of the first web W1 so as to perform a process of proceeding to a state in which it is easy to mix a resin with the fibers by the mixer 50 to be described below.

The rotary body 49 has any configuration; however, in the embodiment, it is possible to have a rotating vane shape by having a plate-shaped vane that rotates. The rotary body 49 is disposed at a position at which the vane comes into contact with the first web W1 peeled from the mesh belt 46. The rotary body 49 rotates (for example, rotates in a direction represented by an arrow R in the drawing), and thereby the vane collides with the first web W1, which is peeled from the mesh belt 46 so as to be conveyed, such that the first web is divided, and a subdivided body P is generated.

It is preferable that the rotary body 49 be installed at a position at which the vane of the rotary body 49 does not collide with the mesh belt 46. For example, it is possible to have a gap of 0.05 mm or larger and 0.5 mm or smaller between a distal end of the vane of the rotary body 49 and the mesh belt 46. In this case, it is possible to divide the first web W1 efficiently without damage to the mesh belt 46 by the rotary body 49.

The subdivided body P divided by the rotary body 49 drops to an inside of a pipe 7 so as to be transported (conveyed) to the mixer 50 along with an air current flowing in the inside of the pipe 7.

In addition, the humidified air generated by the humidifying unit 206 is supplied to a space including the rotary body 49. Consequently, it is possible to suppress a phenomenon in which the fibers are attached to the inside of the pipe 7 or the vane of the rotary body 49 due to static electricity. In addition, air having high humidity is supplied to the mixer 50 through the pipe 7, and thus it is possible to suppress an influence of the static electricity even in the mixer 50.

The mixer 50 communicates with an additive supply unit 52 (resin supply unit) that supplies an additive containing a resin and the pipe 7 and includes the pipe 54, through which an air current containing the subdivided body P flows, and a mixing blower 56. The subdivided body P is a fiber obtained by removing the substance to be removed from the first sorted substance having passed through the first sorting unit 40 as described above. The mixer 50 mixes the fiber configuring the subdivided body P and an additive containing resin.

In the mixer 50, the subdivided body P and the additive are conveyed while the mixing blower 56 generates an air current, and the subdivided body and the additive are mixed in the pipe 54. In addition, the subdivided body P is loosened in a process of flowing inside the pipe 7 and the pipe 54 so as to have a finer fiber shape.

The additive supply unit 52 is connected to a resin cartridge (not shown), in which the additive is accumulated, and supplies the additive inside the resin cartridge to the pipe 54. The additive supply unit 52 temporarily stores the additive made of fine powder or fine particles inside the resin cartridge. The additive supply unit 52 includes a discharge unit 52*a* (resin supply unit) for sending the temporarily stored additive to the pipe 54. The discharge unit 52*a* is provided with a feeder (not shown) for delivering the additive stored in the additive supply unit 52 to the pipe 54 and a shutter (not shown) for opening and closing a pipe channel through which the feeder is connected to the pipe 54. When the shutter is closed, for example, a pipe channel, through which the discharge unit 52*a* is connected to the pipe 54, or an opening is blocked, and thus supply of the additive from the additive supply unit 52 to the pipe 54 is stopped.

In a state in which the feeder of the discharge unit 52*a* does not operate, the additive is not supplied to the pipe 54 from the discharge unit 52*a*; however, in a case or the like where a pressure in the pipe 54 is a negative pressure, there is a possibility that the additive will flow to the pipe 54 even when the discharge unit 52*a* is stopped. The discharge unit 52*a* is closed, and thereby it is possible to reliably block the flowing of the additive.

The additive that is supplied by the additive supply unit 52 includes a resin for binding a plurality of fibers. The resin is a thermoplastic resin or a thermosetting resin, and examples thereof include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, or polyether ether ketone. The resins above may be used individually or in a proper combination thereof. In other words, the additive may contain a single substance, may be a mixture, or may contain a plurality of types of particles that are each configured of a single or a plurality of substances. In addition, the additive may be have a fiber shape or a powder shape.

The resin contained in the additive is melted by being heated so as to cause a plurality of fibers to be bounded to each other. Hence, in a state in which the resin is mixed with the fibers, and the resin is not heated to a temperature at which the resin is melted, the fibers are not bound to each other.

In addition, an additive that is supplied by the additive supply unit 52 may contain a colorant for coloring the fibers, a clumping inhibitor for inhibiting the fibers from clumping or the resin from clumping, or a flame retardant for retarding progression of burning of fibers or the like, depending on a type of sheet to be manufactured, in addition to the resin that causes the fibers to be bound. In addition, an additive that does not contain the colorant may be colorless or have a light color to the extent that the resin looks colorless or may be white.

The subdivided body P dropping through the pipe 7 and the additive that is supplied by the additive supply unit 52 are suctioned to the inside of the pipe 54 due to the air current generated by the mixing blower 56 and pass through the inside of the mixing blower 56. An action of the air current generated by the mixing blower 56 and/or a rotary unit such as the vane included in the mixing blower 56 causes the additive and the fiber configured of the subdivided body P to be mixed, and a mixture (mixture of the first sorted substance and the additive) is transported to the accumulation unit 60 through the pipe 54.

A mechanism that mixes the first sorted substance and the additive is not particularly limited, and a mechanism that performs agitation by a vane which rotates at a high speed may be employed, or a mechanism of using rotation of a container such as a V-shaped mixer may be employed, and the mechanism may be installed in front or rear of the mixing blower 56.

The accumulation unit 60 accumulates the defibrated substances defibrated by the defibration unit 20. More specifically, the accumulation unit 60 introduces the mixture having passed through the mixer 50 from an introduction port 62 and loosens intertwined defibrated substances (fibers) so as to be dropped while the fibers are dispersed in the air. Further, in a case where the additive that is supplied from the additive supply unit 52 has a fiber shape, the accumulation unit 60 loosens the intertwined additives. Consequently, the accumulation unit 60 is capable of accumulating the mixture in the second web former 70 with good uniformity.

In the embodiment, the accumulation unit 60 has a drum portion 61 and a housing portion (cover portion) 63 that accommodates the drum portion 61. The drum portion 61 is a cylinder sieve that is rotatably driven by a motor. The drum portion 61 has a net (a filter or a screen) and functions as a sieve. The drum portion 61 allows fibers or particles that are smaller than a mesh opening (opening) of the net through the mesh of the net and to be dropped from the drum portion 61. For example, a configuration of the drum portion 61 is the same as the configuration of the drum portion 41.

The "sieve" of the drum portion 61 may not have a function of sorting a specific target object. In other words, the "sieve" used as the drum portion 61 means a member having a net, and the drum portion 61 may allow the entire mixture introduced to the drum portion 61 to be dropped.

The second web former 70 is disposed below the drum portion 61. The second web former 70 accumulates passing substances having passed through the accumulation unit 60, and a second web W2 is formed. For example, the second web former 70 includes a mesh belt 72, a roller 74, and a suction mechanism 76.

The mesh belt 72 is an endless belt, is suspended on a plurality of rollers 74, and is conveyed along with motion of the rollers 74 in a direction represented by an arrow in the drawing. For example, the mesh belt 72 is made of metal, resin, fabric, or nonwoven fabric. The mesh belt 72 has a surface configured of a net in which openings having a predetermined size are arranged. Among the first fibers or particles dropping from the drum portion 61, fine particles having a size to the extent that it is possible to pass through the mesh of the net fall downward from the mesh belt 72, and fibers having a size to the extent that it is not possible to pass through the mesh of the net are accumulated on the mesh belt 72 and are conveyed along with the mesh belt 72 in an arrow direction. The mesh belt 72 moves at a constant speed V2 at the time of an operation of manufacturing the sheet S.

The mesh belt 72 has minute meshes of the net, and the mesh can have a size so as not to allow most of the fibers or particles dropping from the drum portion 61 to pass through the mesh belt.

The suction mechanism 76 is provided below the mesh belt 72 (on a side opposite to a side of the accumulation unit 60). The suction mechanism 76 includes a suction blower 77, and thus it is possible to generate an air current (air current toward the mesh belt 72 from the accumulation unit 60) toward below the suction mechanism 76 with a suction force of the suction blower 77.

The suction mechanism 76 suctions mixtures dispersed in the air by the accumulation unit 60 to the mesh belt 72. Consequently, it is possible to promote forming of the second web W2 on the mesh belt 72 and to increase a discharge speed from the accumulation unit 60. Further, the suction mechanism 76 is capable of forming a down flow in a falling route of the mixture and preventing the defibrated substances and the additive from being intertwined during falling.

The suction blower 77 (accumulating suction unit) may discharge air suctioned from the suction mechanism 76 to the outside of the sheet manufacturing apparatus 100 through a trapping filter not shown. Alternatively, the air suctioned by the suction blower 77 may be sent into the dust collecting unit 27, and the substance to be removed, which is contained in the air suctioned by the suction mechanism 76, may be trapped.

The humidified air generated by the humidifying unit 208 is supplied to a space including the drum portion 61. It is possible to humidify an inside of the accumulation unit 60 with the humidified air, and thus it is possible to suppress the fibers or the particles from being attached to the housing portion 63 due to the electrostatic force, to drop the fibers and the particles rapidly to the mesh belt 72, and to form the second web W2 into a preferable shape.

As described above, through the accumulation unit 60 and the second web former 70 (a web forming step), the second web W2 is formed in a state of containing a large amount of air and being soft and expanded. The second web W2 accumulated on the mesh belt 72 is conveyed to the sheet former 80.

In a conveyance route of the mesh belt 72, the humidifying unit 212 supplies air containing mist to a downstream side of the accumulation unit 60. Consequently, the mist which is generated by the humidifying unit 212 is supplied to the second web W2, and an amount of moisture contained in the second web W2 is adjusted. Consequently, it is possible to suppress attachment or the like of a fiber to the mesh belt 72 due to the static electricity.

The sheet manufacturing apparatus 100 includes the conveying unit 79 that is provided to convey the second web W2 on the mesh belt 72 to the sheet former 80. For example, the conveying unit 79 includes a mesh belt 79*a*, a roller 79*b*, and a suction mechanism 79*c*.

The suction mechanism 79*c* generates an air current so as to suction the second web W2 and attaches the second web W2 to the mesh belt 79*a*. The mesh belt 79*a* moves along with rotation of the roller 79*b* and conveys the second web W2 to the sheet former 80. For example, a movement speed of the mesh belt 72 is the same as a movement speed of the mesh belt 79*a*. In this manner, the conveying unit 79 peels the second web W2 formed on the mesh belt 72 from the mesh belt 72 so as to transport the second web.

The sheet former 80 forms the sheet S of the accumulated substances accumulated by the accumulation unit 60. More specifically, the sheet former 80 pressurizes and heats the second web W2 (accumulated substances) which is accumulated on the mesh belt 72 and conveyed by the conveying unit 79 so as to form the sheet S. In the sheet former 80, fibers of a defibrated substance and an additive which are contained in the second web W2 are heated, and thereby a plurality of fibers in a mixture are bound to each other via the additive (resin).

The sheet former 80 has a pressurizing unit 82 that pressurizes the second web W2 and a heating unit 84 that heats the second web W2 pressurized by the pressurizing unit 82.

The pressurizing unit 82 is configured of a pair of calendar rollers 85 and nips and pressurizes the second web W2 therebetween with a predetermined nip pressure. The second web W2 decreases in thickness by being pressurized, and density of the second web W2 increases. One of the pair of calendar rollers 85 is a drive roller that is driven by a motor (not shown), and the other roller is a driven roller. The calendar roller 85 rotates by a drive force of a motor (not shown) so as to convey the second web W2 having high density due to pressurization toward the heating unit 84.

For example, the heating unit 84 can be configured to use a heating roller (heater roller), a thermal press forming device, a hot plate, a hot air blower, an infrared heater, or a flash fixing device. In the embodiment, the heating unit 84 has a pair of heating rollers 86. The heating rollers 86 are warmed to a preset temperature by a heater that is installed inside or outside. The heating rollers 86 nips the second web W2 pressurized by the calendar roller 85 so as to apply heat to the second web and forms the sheet S. In addition, one of the pair of heating rollers 86 is a drive roller that is driven by a motor (not shown), and the other roller is a driven roller. The heating roller 86 rotates by a drive force of a motor (not shown) so as to convey the heated sheet S toward the cutter 90.

The number of the calendar rollers 85 included in the pressurizing unit 82 and the number of the heating rollers 86 included in the heating unit 84 are not particularly limited.

The cutter 90 cuts the sheet S formed by the sheet former 80. In the embodiment, the cutter 90 includes a first cutter 92 that cuts the sheet S in a direction intersecting a conveyance direction of the sheet S and a second cutter 94 that cuts the sheet S in a direction parallel to the conveyance direction. For example, the second cutter 94 cuts the sheet S having passed through the first cutter 92.

As described above, a single sheet S having a predetermined size is formed. The cut single sheet S is discharged to a discharge unit 96. The discharge unit 96 has a paper discharge tray that discharges the sheet S having a predetermined size or a stacker in which the sheets S are accumulated.

Figure 2:
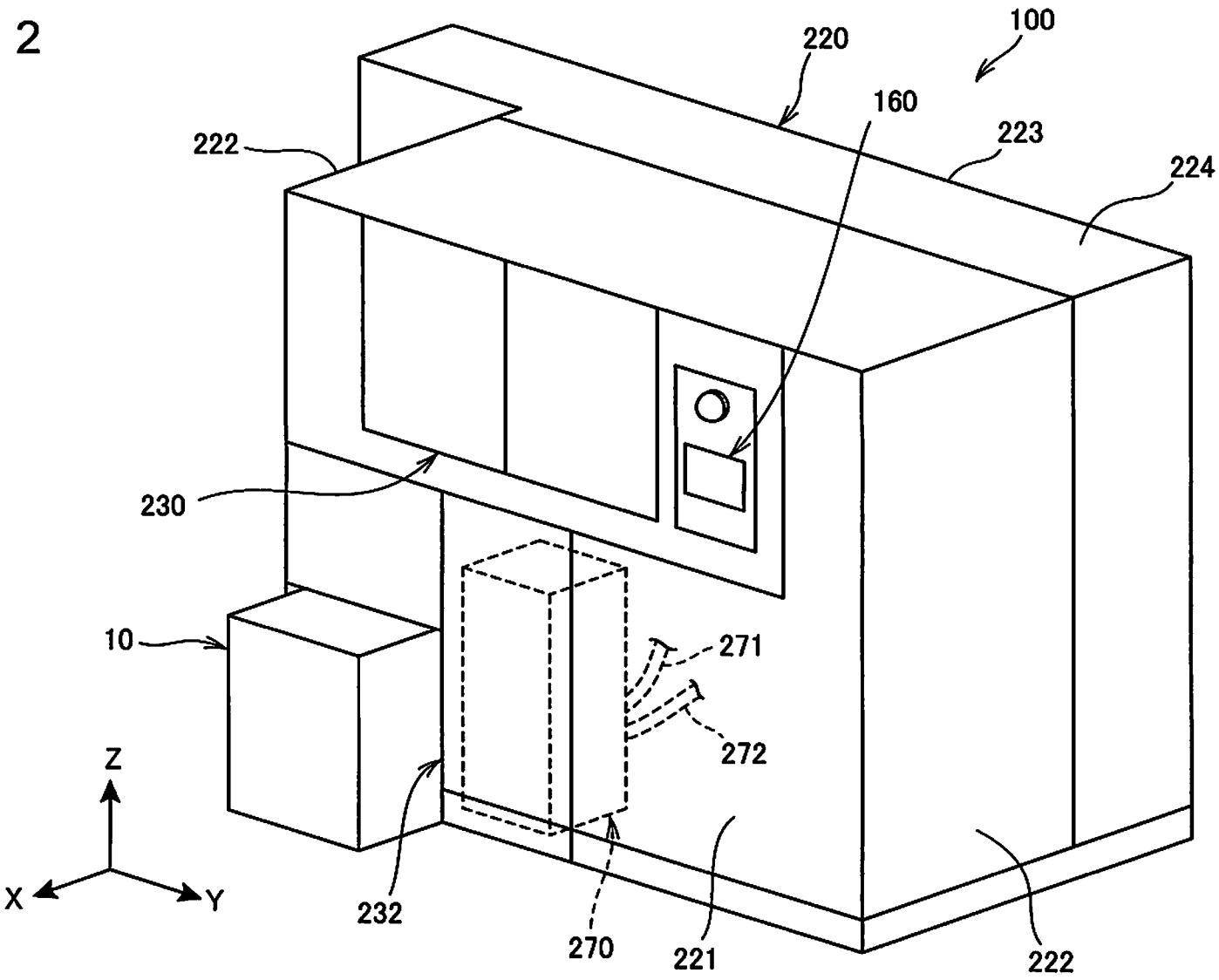
FIG. 2 is a diagram showing an external appearance of the sheet manufacturing apparatus.

FIG. 2 shows an external appearance of the sheet manufacturing apparatus 100.

As shown in FIG. 2, the sheet manufacturing apparatus 100 includes a housing 220 that accommodates configurational components described above of the sheet manufacturing apparatus 100. The housing 220 is provided with a front surface portion 221 that configures a front surface, a side surface portions 222 that configures a right or left side surface, a back surface portion 223 that configures a back surface, and an upper surface portion 224 that configures an upper surface.

In FIG. 2 and the drawings to be described below, a reference sign X represents a depth direction (direction from the back surface toward the front surface) of the sheet manufacturing apparatus, a reference sign Y represents a width direction of the sheet manufacturing apparatus, and a reference sign Z represents a height direction of the sheet manufacturing apparatus 100.

On the front surface portion 221, the supply unit 10 is provided to have a part that is exposed, and a display unit 160 that displays various items of information, an opening/closing door 230, and a front cover 232 are provided. The display unit 160 includes a display panel, on which the various items of information can be displayed, and a touch panel that is disposed to overlap the display panel, and the touch panel makes it possible to detect an operation by the user. The opening/closing door 230 is a door that is opened and closed such that an additive cartridge is exposable. The front cover 232 is provided below the opening/closing door 230 and makes it possible to access to an in-device tank 270 (water tank) provided in the housing 220 from outside.

The in-device tank 270 functions as a common water tank that accumulates water that is used by the vaporization-type humidifying unit 300 and the mist-type humidifying unit 400. In other words, the in-device tank 270 has water pipings 271 and 272 that are connected to the vaporization-type humidifying unit 300 and the mist-type humidifying unit 400, respectively.

Figure 3:
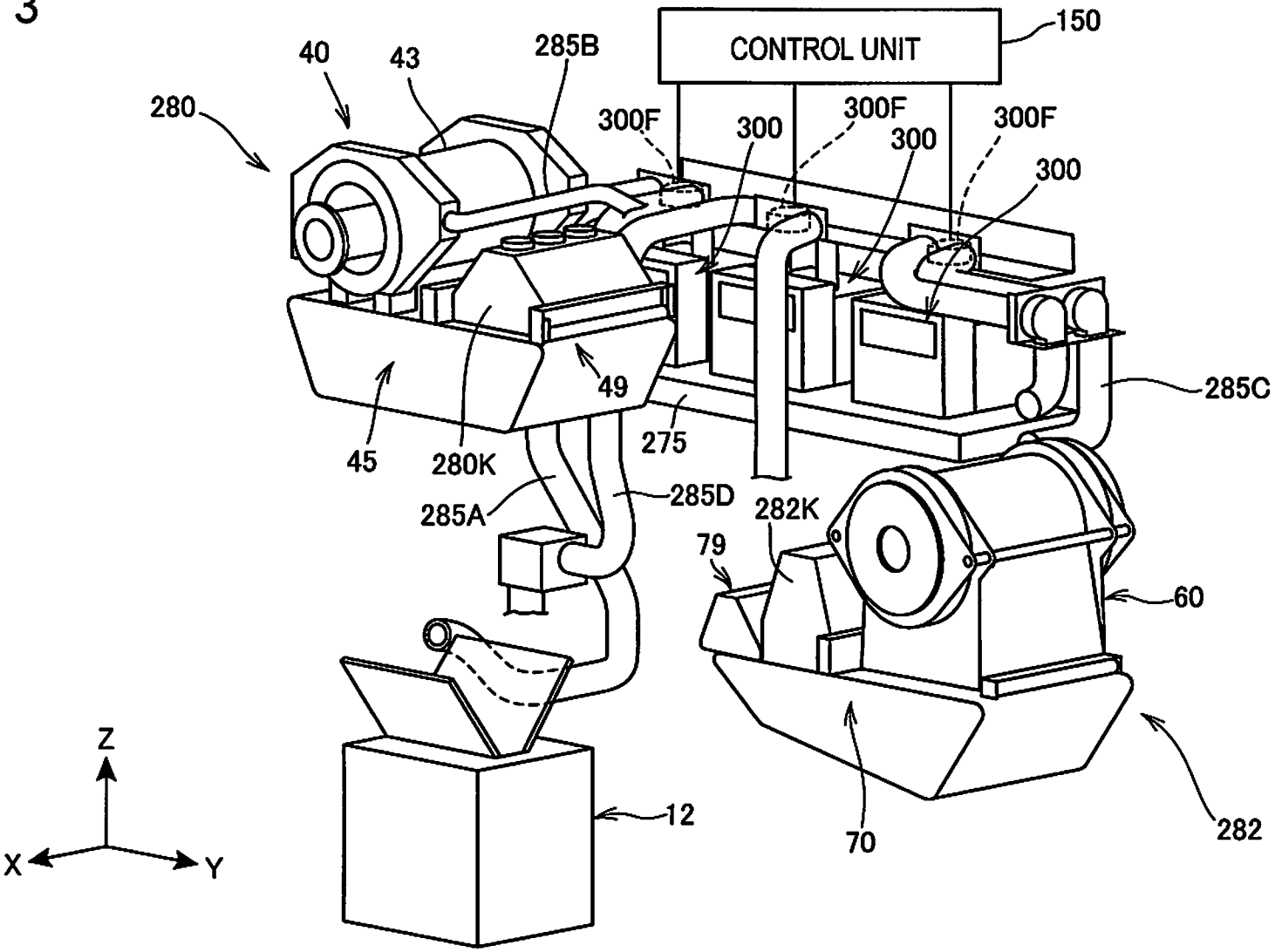
FIG. 3 is a diagram showing a vaporization-type humidifying unit and a peripheral configuration.
Figure 4:
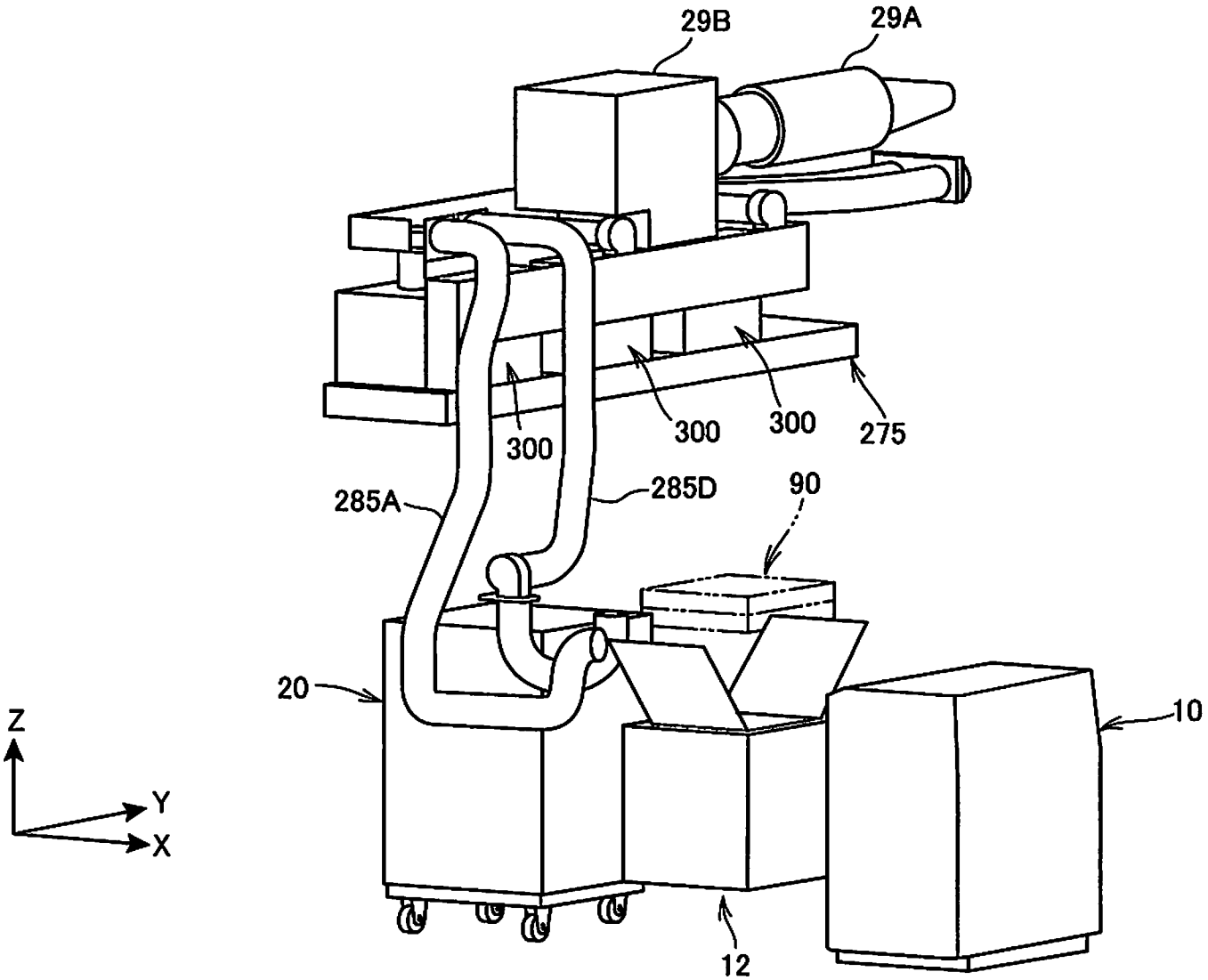
FIG. 4 is a diagram showing the vaporization-type humidifying unit and the peripheral configuration when viewed from another direction.

FIGS. 3 and 4 are views showing the vaporization-type humidifying unit 300 and a peripheral configuration.

FIG. 3 shows disposition when viewed from a right side of the front surface of the sheet manufacturing apparatus 100, and FIG. 4 shows disposition when viewed from a left side of the front surface thereof. In addition, the sheet manufacturing apparatus 100 includes a control unit 150 that controls every member of the sheet manufacturing apparatus 100.

As shown in FIGS. 3 and 4, the vaporization-type humidifying unit 300 is mounted on a support base 275 that is horizontally provided above the supply unit 10. In the configuration, a plurality of (three) vaporization-type humidifying units 300 are provided at intervals in a Y direction (right-left direction).

The vaporization-type humidifying unit 300 (vaporization-type humidifier) includes a water tray (not shown) that stores water and a humidifying filter (not shown) of which a part is immersed in water in the water tray. The vaporization-type humidifying unit causes air to pass through the humidifying filter, and thereby the humidified air having high humidity is supplied. In addition, the vaporization-type humidifying unit 300 may include a heater (not shown) that increases the humidity of the humidified air effectively.

On a side of a front surface of the vaporization-type humidifying unit 300, a first unit 280 that has the sorting unit 40, the first web former 45, and the rotary body 49 and a second unit 282 that has the accumulation unit 60, the second web former 70, and the conveying unit 79 are supported at an interval in the Y direction. In addition, the rough crushing unit 12 is disposed below and on the side of the front surface (side in an X direction) of the first unit 280 and the second unit 282.

As shown in FIG. 4, the supply unit 10 is positioned on the side of the front surface (side in the X direction) with respect to the rough crushing unit 12, and the defibration unit 20 is positioned on the side of the back surface (−X side) with respect to the rough crushing unit 12. In addition, the cutter 90 is positioned in the vicinity of a portion above the rough crushing unit 12. An air current returning pipe 29A, into which a part of the air current that is discharged by the trapping blower 28 flows, is provided above the vaporization-type humidifying unit 300. A chamber 29B is provided on a downstream end of the air current returning pipe 29A, and air is supplied to each of the vaporization-type humidifying units 300 via the chamber 29B.

The vaporization-type humidifying unit 300 includes an air suction fan 300F (FIG. 3) that functions as a suction unit that suctions air in the vaporization-type humidifying unit 300. The control unit 150 operates the air suction fan 300F, and thereby air in the vaporization-type humidifying unit 300 is humidified and is supplied as the humidified air downstream of the air suction fan 300F. A plurality of pipes 285A to 285D (humidified air supply pipes) are connected downstream of the air suction fan 300F, and the humidified air is supplied to every member via the plurality of pipes 285A to 285D.

Specifically, as shown in FIGS. 3 and 4, the humidified air is supplied above the rough crushing unit 12 via the pipe 285A that extends from the vaporization-type humidifying unit 300 and is open in the vicinity of a portion above the rough crushing unit 12. The humidified air is directly suctioned to the rough crushing unit 12 with a suction force of the defibration unit blower 26 and humidifies an inner space of the rough crushing unit 12, that is, a space in which the raw material is roughly crushed. In addition, since air in the rough crushing unit 12 supplied to the defibration unit 20 via the defibration unit blower 26, a downstream inner space including the defibration unit 20 is also humidified.

Further, as shown in FIG. 3, the humidified air is also supplied into the drum portion 41 via the pipe 285B that is connected from the vaporization-type humidifying unit 300 to the housing portion (cover portion) 43 of the sorting unit 40. In addition, the humidified air of the vaporization-type humidifying unit 300 is also directly supplied to a space of the division unit (rotary body 49 and the pipe 7). Consequently, the rough crushing unit 12 and an entire space through which the fragmented raw materials (rough-crushed pieces, defibrated substances, or the like) pass, including the defibration unit 20, are humidified, and it is possible to suppress the occurrence of static electricity in the spaces. Hence, it is possible to suppress an occurrence of a situation in which the fragmented raw materials are attached to portions so as to result in remaining or a situation in which the raw materials are attached to each other due to the influence of charging. In addition, since the air humidified by the vaporization-type humidifying unit 300 does not cause a saturated steam amount, generation of condensation is suppressed, and attachment or the like between the raw materials to each other due to moisture is suppressed.

In addition, as shown in FIG. 3, the humidified air is directly sent to an upstream part of the accumulation unit 60 via the pipe 285C that extends from the vaporization-type humidifying unit 300 to the accumulation unit 60. The humidified air flows from the upper side to the lower side of the accumulation unit 60 along with the flowing of the air current generated by the suction blower 77 and humidifies an inner space of the accumulation unit 60.

In this manner, it is possible to suppress an occurrence of the static electricity in the entire space of the accumulation unit 60 and to suppress a situation in which the fragmented raw materials (fibers or additives) in the accumulation unit 60 are attached to portions so as to result in remaining or a situation in which the raw materials are attached to each other. In addition, the generation of the condensation is suppressed such that the attachment of the raw materials to each other due to moisture is also suppressed.

Further, as shown in FIG. 4, the pipe 285D that extends from the vaporization-type humidifying unit 300 and is open in the vicinity of the cutter 90 humidifies a space, in which the second web W2 is conveyed from the second web former 70 positioned upstream of the cutter 90 and a space of the cutter 90. Consequently, the generation of the static electricity in a conveyance space of the second web W2 and in the cutter 90 is suppressed, it is possible to suppress adhesion of the second web W2, adhesion of the sheet S or a cut piece, or the like, and the generation of the condensation is suppressed.

The number of vaporization-type humidifying units 300 may be optionally set, and one unit may be provided as long as it is possible to secure a necessary humidifying amount.

Figure 5:
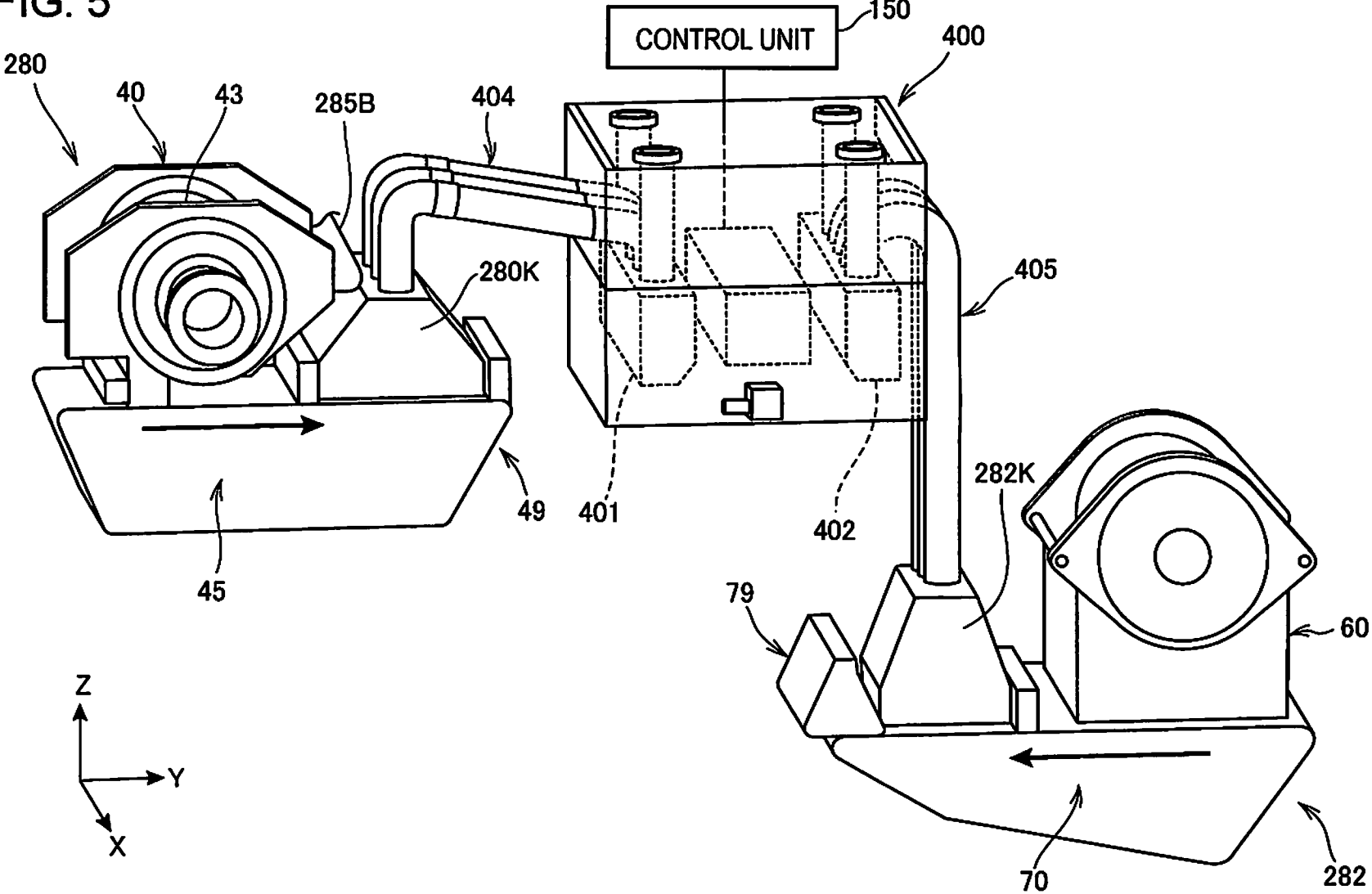
FIG. 5 is a diagram showing a mist-type humidifying unit and a peripheral configuration.

FIG. 5 is a diagram showing the mist-type humidifying unit 400 and a peripheral configuration. FIG. 5 shows disposition when viewed substantially from a side of the front surface of the sheet manufacturing apparatus 100.

The mist-type humidifying units 400 (mist-type humidifiers) are provided in intervals in the Y direction (right-left direction) between the first unit 280 and the second unit 282. The mist-type humidifying unit 400 includes a first mist unit 401 that supplies mist to the first unit 280 and a second mist unit 402 that supplies mist to the second unit 282.

Each of the first and second mist units 401 and 402 includes a water tray (not shown) that stores water and a vibrating portion (not shown) that atomizes water in the water tray. The mist units 401 and 402 are capable of supplying mist generated by the vibrating portion independently.

In addition, the mist-type humidifying unit 400 includes a first piping 404 (first mist supply pipe), which connects the first mist unit 401 to the first unit 280, and a second piping 405 (second mist supply pipe), which connects the second mist unit 402 to the second unit 282. The number of mist units is not limited two, and one mist unit may be provided as long as it is possible to sufficiently secure generation performance of mist.

The control unit 150 controls operations of the first and second mist units 401 and 402, thereby, generating mist from each of the mist units 401 and 402.

Here, the first unit 280 is provided with a cover 280K that covers a region on a downstream side of the sorting unit 40 in the mesh belt 46 (separation belt) from above, and the first piping 404 is connected to the cover 280K.

The first piping 404 extends toward the first unit 280 from the first mist unit 401 and, then, is bent to extend in a perpendicular direction, and a lower end thereof is connected to the cover 280K. In this manner, the first mist unit 401 supplies mist in a direction orthogonal to the first web W1. In addition, the first piping 404 is configured of a plurality of pipings across the mesh belt 46 in a width direction thereof and is capable of supplying the mist uniformly across the entire width of the first web W1.

Here, the second unit 282 is provided with a cover 282K that covers a region on a downstream side of the accumulation unit 60 in the mesh belt 72 from above, and the second piping 405 is connected to the cover 282K. The second piping 405 is bent from the second mist unit 402 so as to extend in the perpendicular direction, and a lower end thereof is connected to the cover 282K. In this manner, the second mist unit 402 supplies mist in a direction orthogonal to the second web W2. In addition, the second piping 405 is configured of a plurality of pipings across the mesh belt 72 in a width direction thereof and is capable of supplying the mist uniformly across the entire width of the second web W2.

Since the first web W1 and the second web W2 are directly humidified with mist, it is possible to humidify the first web W1 and the second web W2 with sufficient humidity suitable for manufacturing the sheet S. In addition, since a range of humidity control is little influenced by the saturated steam amount of air that depends on a temperature, it is possible to adjust the humidity to desired humidity. For example, adjustment of a vibration amount or an amount of an amplitude of the vibrating unit makes it possible to adjust an amount of mist.

The first web W1 and the second web W2 have a predetermined moisture amount, and thereby it is possible to suppress adhesion of the first web W1 and the second web W2 to the mesh belts 46 and 72 due to the influence of charging, for example. In addition, it is possible to efficiently induce a hydrogen bond between fibers of the sheet S when the heating unit 84 performs heating.

Here, in the configuration, as shown in a conveyance direction represented by an arrow in FIG. 5, the first unit 280 and the second unit 282 are disposed such that a conveyance direction of the first web W1 is opposite to a conveyance direction of the second web W2. Therefore, mist supply positions in the first and second units 280 and 282 can be close to the mist-type humidifying unit 400 that is disposed between the first and second units 280 and 282. Hence, it is possible to shorten piping lengths of the first and second pipings 404 and 405, and it is easy to appropriately supply the mist to portions.

In addition, the control unit 150 performs a water supply control to the in-device tank 270, the vaporization-type humidifying unit 300, and the mist-type humidifying unit 400 at the time of starting up of the sheet manufacturing apparatus 100 and performs a water discharge control thereof at the time of the operation stop of the sheet manufacturing apparatus 100.

Figure 6:
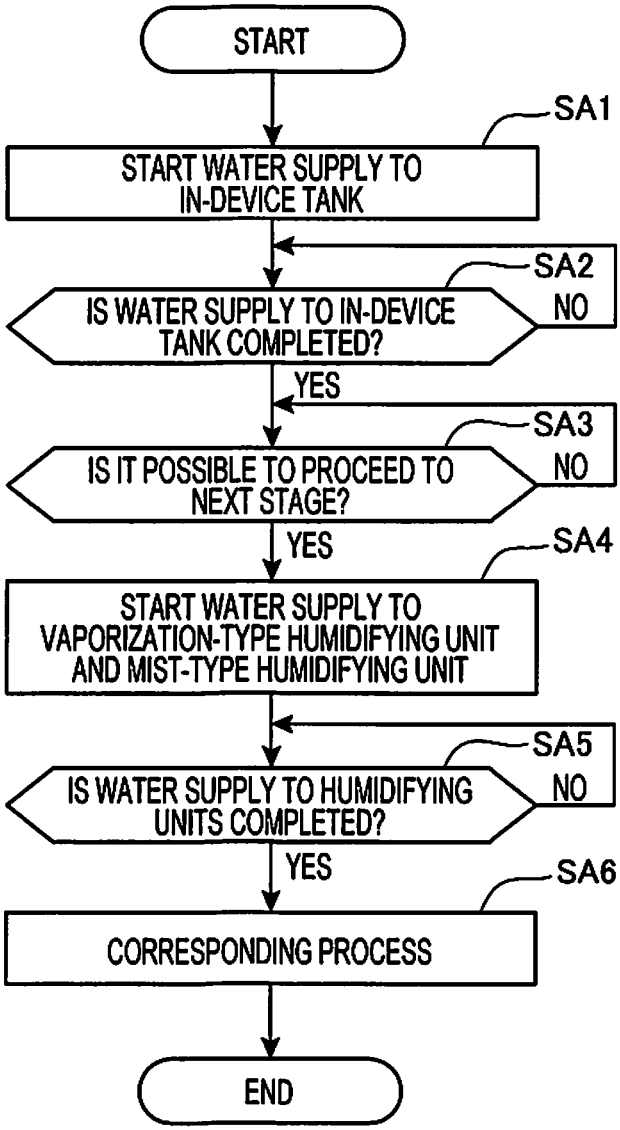
FIG. 6 is a flowchart showing a water supply control at a time of starting up of the sheet manufacturing apparatus.

FIG. 6 is a flowchart simply showing the water supply control at the time of the starting up of the sheet manufacturing apparatus 100. At the time of the starting up, the front cover 232 (FIG. 2) of the sheet manufacturing apparatus 100 is opened, an external tank, from which water comes, is disposed close to the in-device tank 270, and a water supply/discharge hose provided on the side of the in-device tank 270 is inserted into the external tank. In addition, the control unit 150 starts the water supply control at the time of the starting up when a water supply instruction is input by a user via the touch panel of the display unit 160 after the starting up of the sheet manufacturing apparatus 100.

First, the control unit 150 operates a predetermined pump (not shown) so as to supply water to the in-device tank 270 from the external pump (Step SA1). When the water supply is started, the control unit 150 determines whether or not the water supply to the in-device tank 270 by a preset water supply amount is completed, based on a detection result from a predetermined sensor (not shown) that detects a water level or a water supply amount (Step SA2). In a case where the water supply is not completed, the control unit 150 executes a process of Step SA2 repeatedly.

When the water supply to the in-device tank 270 is completed, the control unit 150 determines whether or not an operation of a predetermined pump is stopped and it is possible to proceed to the next stage (Step SA3). In the configuration, when the user puts aside the external tank and work of closing the front cover 232 is performed, it is possible to proceed to the next stage. For example, in a case of detecting that the front cover 232 is closed, the control unit 150 determines that, in a case where the user inputs a predetermined instruction, it is possible to proceed to the next stage.

When determining that it is possible to proceed to the next stage, the control unit 150 causes an on-off valve (not shown) that is provided in each of the water pipings 271 and 272 to come into an opened state, the water supply pump (not shown) is operated such that water in the in-device tank 270 is supplied to each of the humidifying units 300 and 400 (Step SA4). Consequently, water is stored in the water trays of the humidifying units 300 and 400.

Subsequently, the control unit 150 determines whether or not a predetermined amount of water supply to the humidifying units 300 and 400 is completed, based on a detection result from a predetermined sensor (not shown) that detects a water level or a water supply amount (Step SA5).

When the control unit determines that the water supply to the humidifying units 300 and 400 is completed, the control unit 150 executes a corresponding process (Step SA6). The corresponding process is a notification process of notifying a control of stopping the water supply pump and closing the on-off valve, a notification that the water supply is completed, or the like. The above control is the water supply control at the time of the starting up. When the water supply control is completed, it is possible to perform operations of parts including the humidifying units 300 and 400, which are necessary for manufacturing the sheet S.

While the humidifying units 300 and 400 are operated, the control unit 150 monitors whether or not water stored in the water trays of the humidifying units 300 and 400 is less than a predetermined lower limit amount. When the water is less than the lower limit amount, the control unit causes water supply to be performed from the in-device tank 270 to the water tray. Consequently, the control unit 150 performs the water supply control such that a predetermined amount of water is stored in both of the humidifying units 300 and 400 during the time from the starting up to the operation stop of the sheet manufacturing apparatus 100.

Figure 7:
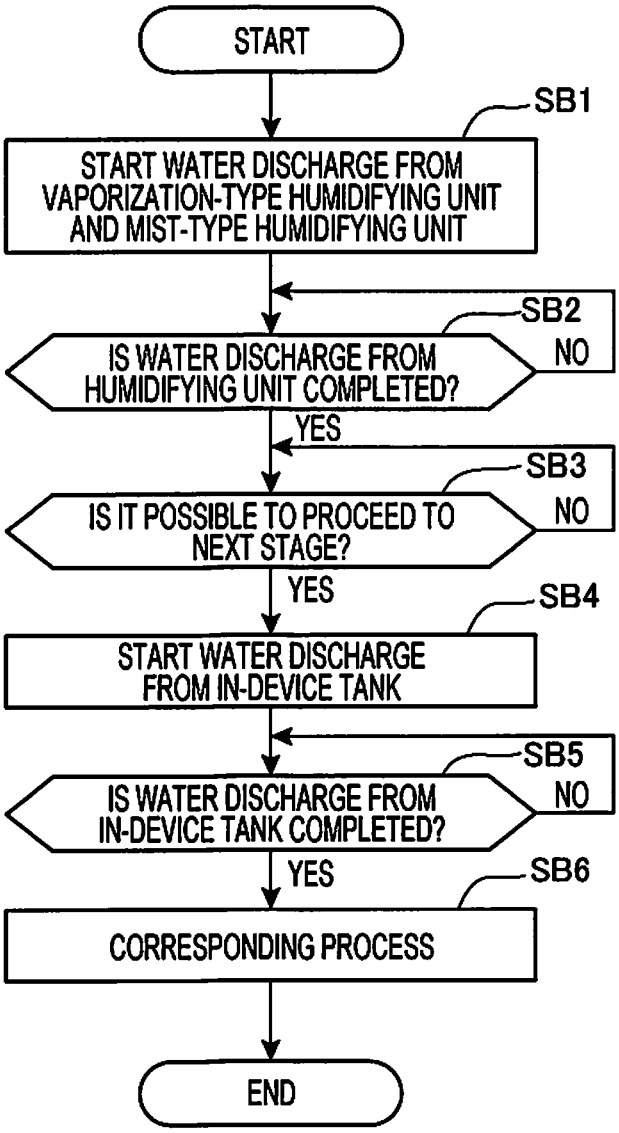
FIG. 7 is a flowchart showing a water supply control at a time of an operation stop of the sheet manufacturing apparatus.

FIG. 7 is a flowchart simply showing the water discharge control at the time of the operation stop of the sheet manufacturing apparatus 100. As a premise, in a case where the operation of the sheet manufacturing apparatus 100 is stopped, the control unit 150 stops operations of predetermined parts such as the humidifying units 300 and 400 and starts the water discharge control at the time of the operation stop when a water discharge instruction is input by the user via the touch panel of the display unit 160.

First, the control unit 150 causes the on-off valve (not shown) that is provided in each of the water pipings 271 and 272 to come into the opened state, the control unit causes water in the humidifying units 300 and 400 to move to the in-device tank 270 by the gravity (Step SB1). In the configuration, since both of the humidifying units 300 and 400 are positioned above the in-device tank 270, it is possible to discharge water by the gravity. However, the invention is not limited to the configuration, and a discharge pump may be provided to discharge water by an operation of the water discharge pump.

Next, the control unit 150 may determine whether or not water discharge from both of the humidifying units 300 and 400 is completed. For example, the control unit 150 may perform determination based on a detection result from a predetermined sensor or perform determination based on whether or not a predetermined time elapses after the on-off valve is opened.

When the control unit determines that the water discharge from the humidifying units 300 and 400 is completed (Step SB2), the control unit 150 determines it is possible to proceed to the next stage (Step SB3).

In the configuration, in a case where the front cover 232 of the sheet manufacturing apparatus 100 is opened by the user or the like, the empty external tank is disposed close to the in-device tank 270, and the water supply/discharge hose provided on the side of the in-device tank 270 is inserted into the external tank, it is possible to proceed to the next stage. For example, in a case of detecting that the front cover 232 is closed, the control unit 150 determines that, in a case where the user inputs a predetermined instruction, it is possible to proceed to the next stage.

When the control unit determines that it is possible to proceed to the next stage, the control unit 150 operates a predetermined pump (not shown) so as to discharge water from the in-device tank 270 to the external pump (Step SB4). When the water discharge is started, the control unit 150 determines whether or not the water discharge from the in-device tank 270 is completed, based on a detection result from a predetermined sensor (not shown) (Step SB5).

When the control unit determines that the water discharge is completed, the control unit 150 executes a corresponding process (Step SB6). The corresponding process is a notification process of notifying a control of stopping a predetermined pump, a notification that the water discharge is completed, or the like. The above control is the water discharge control at the time of the stop.

As described above, the sheet manufacturing apparatus 100 of the embodiment includes: the rough crushing unit 12 that roughly crushes the raw material containing fibers; and the defibration unit 20 that defibrates the roughly crushed raw material in a gas atmosphere. In addition, the sheet manufacturing apparatus 100 includes: the first and second web formers 45 and 70 that accumulate defibrated substances obtained through the defibrating process and form webs W1 and W2; and the sheet former 80 that forms the sheet S of the second web W2. In addition, the sheet manufacturing apparatus 100 includes: a vaporization-type humidifying unit 300 that humidifies the space in which the raw material is roughly crushed by the rough crushing unit 12; and a mist-type humidifying unit 400 that humidifies the webs W1 and W2 that are formed by the first and second web formers 45 and 70.

According to the configuration, it is possible to humidify the space through which the fragmented raw materials pass, by the vaporization-type humidifying unit 300, while the occurrence of condensation is suppressed, and it is possible to suppress remaining of the raw material or attachment of the raw materials to each other due to the influence of charging. In addition, it is possible to humidify the webs W1 and W2 obtained by the accumulation of the defibrated substances, by the mist-type humidifying unit 400, without depending on the saturated steam amount of air. Hence, it is possible to appropriately humidify both the raw materials that are caused to remain or be attached to each other due to the influence of charging and the webs W1 and W2 obtained by the accumulation of the defibrated substances.

In addition, since the vaporization-type humidifying unit 300 humidifies the inside of the accumulation unit 60 that accumulates the defibrated substances defibrated by the defibration unit 20, it is possible to suppress remaining of the fragmented raw materials (the fibers or the additives) or attachment of the raw materials to each other in the accumulation unit 60 due to the influence of charging.

In addition, the mesh belts 46 and 72 (separation belts), on which the defibrated substances are accumulated, are provided, and the first and second web formers 45 and 70 (separation units) that separates the matter to be removed, which is not used in a sheet S, from the defibrated substances. The vaporization-type humidifying unit 300 humidifies a space in which the defibrated substances drop to the mesh belts 46 and 72 so as to be accumulated, and the mist-type humidifying unit 400 humidifies the accumulated substances accumulated on the mesh belts 46 and 72.

Consequently, it is possible to suppress remaining or attachment of the raw materials to each other due to the influence of charging in the fragmented raw materials that configure the defibrated substances, and it is possible to perform humidification to the extent that the accumulated substances accumulated on the mesh belts 46 and 72 do not adhere to the mesh belts 46 and 72.

In addition, the sheet manufacturing apparatus includes: the dust collecting unit 27 that traps the matter to be removed, which has been separated by the first web former 45. The air having passed through the defibration unit 20, the first web former 45, and the dust collecting unit 27, in this order, is introduced as the humidifying target air to the vaporization-type humidifying unit 300. Consequently, the air having passed through the defibration unit 20, the first web former 45, and the dust collecting unit 27 is humidified by the vaporization-type humidifying unit 300 and returns to the space of the rough crushing unit 12 that is positioned upstream. Consequently, it is possible to humidify spaces of the members from the rough crushing unit 12 to the downstream of the rough crushing unit 12 by using the air used in the manufacturing of the sheet S. The air warmed by the defibration unit 20 is used by the vaporization-type humidifying unit 300, and the vaporization-type humidifying unit 300 is capable of performing humidification efficiently.

In addition, the sheet manufacturing apparatus includes the rotary body 49 that functions as a division unit which divides the first web W1 accumulated on the mesh belt 46, and the vaporization-type humidifying unit 300 humidifies the space in which the rotary body 49 divides the first web W1. Consequently, it is possible to suppress remaining of the raw material (first web W1) or the attachment of the raw materials to each other due to the influence of charging in the space in which the first web W1 is divided.

In addition, the sheet manufacturing apparatus includes: the mixer 50 that mixes the resin and the defibrated substances that configure a subdivided body divided by the rotary body 49. The second web former 70 accumulates mixtures mixed by the mixer 50 and forms the second web W2. Since it is possible to suppress remaining or attachment of the defibrated substances, it is possible to appropriately perform mixing with the resin, and it is possible to appropriately form the second web W2 with the mixed mixture.

In addition, the sheet manufacturing apparatus includes: the cutter 90 that cuts the sheet S formed by the sheet former 80. The vaporization-type humidifying unit 300 humidifies the space in which the second web W2 is conveyed from the second web W2 from the second web former 70 and the space of the cutter 90. Consequently, it is possible to suppress adhesion of the second web W2, adhesion of the sheet S to the cut piece, or the like.

In addition, the sheet manufacturing apparatus includes: the in-device tank 270 that functions as the water tank which stores water. The water is supplied from the in-device tank 270 to the vaporization-type humidifying unit 300 and the mist-type humidifying unit 400. Consequently, it is possible to combine the tanks that supply water to the vaporization-type humidifying unit 300 and the mist-type humidifying unit 400, and thus it is advantageous in a reduction in the number of components and a reduction in size of the sheet manufacturing apparatus 100.

In addition, the sheet manufacturing apparatus includes the control unit 150 that controls the water supply to the vaporization-type humidifying unit 300 and the mist-type humidifying unit 400. The control unit 150 controls the water supply to the in-device tank 270 at the time of starting up as water supply control. In addition, the control unit 150 controls the water supply to both of the humidifying units 300 and 400 from the in-device tank 270 as the water supply control such that an amount of water equal to or larger than the predetermined amount is stored in the vaporization-type humidifying unit 300 and the mist-type humidifying unit 400 in a time from the starting up to the operation stop.

Consequently, the control by the control unit 150 enables water to be supplied to the in-device tank 270 at the time of the starting up and the humidifying units 300 and 400 to continue humidification by using water supplied at the time of the starting up.

In addition, the control unit 150 controls the water discharge to the in-device tank 270 from the vaporization-type humidifying unit 300 and the mist-type humidifying unit 400, as the water discharge control at the time of the apparatus stop and controls the water discharge from the in-device tank 270. Consequently, the control by the control unit 150 enables water to be discharged to the in-device tank 270 from both of the humidifying units 300 and 400 and water to be discharged from the in-device tank 270 at the time of apparatus stop.

The embodiment described above is only a specific aspect for implementing the present invention described in Claims, and the present invention is not limited thereto. The entire configuration described in the embodiment is not also limited as the essential configuration requirement of the present invention. In addition, the invention is not limited to the configurations of the embodiments described above, and it is possible to implement the invention in various aspects within a range without departing from a gist thereof.

For example, a product is not limited to the sheet S, and the sheet manufacturing apparatus 100 may be configured to manufacture a hard sheet or a board-like or a web-like product configured of stacked sheets. In addition, the sheet S and paper may be paper manufactured by using pulp or used paper as the raw material or may be a nonwoven fabric containing natural fibers or synthetic resin fibers. In addition, the property of the sheet S is not particularly limited. The sheet may be paper that can be used as recording paper (for example, a so-called PPC sheet) for writing or printing or may be used as wall paper, wrapping paper, colored paper, drawing paper, kent paper, or the like. In addition, in a case where the sheet S is the nonwoven fabric, the sheet may be used as a textile board, tissue paper, kitchen paper, a cleaner, a filter, a liquid absorbent, a sound absorber, a cushioning material, a mat, or the like, in addition to the common nonwoven fabric.

In addition, in the embodiment described above, a configuration is described, in which the sheet S is cut by the cutter 90; however, a configuration may be employed, in which the sheet S processed by the sheet former 80 is wound around the winding roller.

REFERENCE SIGNS LIST

2, 3, 7, 8, 23, 29, 54 pipe
9 chute
10 supply unit
10A stacker
10B tray
10C supply unit main body
12 rough crushing unit
14 rough crushing blade
15 drive unit
16 ionizer
20 defibration unit
22 introduction port
24 discharge port
26 defibration unit blower
27 dust collecting unit
28 trapping blower (suction unit)
40 sorting unit
41 drum portion
42 introduction port
43 housing portion
45 first web former
46 mesh belt (separation belt)
47 stretching roller
48 suction unit
49 rotary body (division unit)
50 mixer
51 additive supply unit
52*a* discharge unit
56 mixing blower
60 accumulation unit
61 drum portion
62 introduction port
63 housing portion
70 second web former
72 mesh belt (separation belt)
74 stretching roller
76 suction mechanism
77 suction blower
79 conveying unit
79*a* mesh belt
79*b* stretching roller
79*c* suction mechanism
80 sheet former
82 pressurizing unit
84 heating unit
85 calendar roller
86 heating roller
90 cutter
92 first cutter
94 second cutter
96 discharge unit
100 sheet manufacturing apparatus
150 control unit
160 display unit
202, 204, 206, 208, 210, 212 humidifying unit
220 housing
221 front surface portion
222 side surface portion
223 back surface portion
224 upper surface portion
230 opening/closing door
232 front cover
270 in-device tank (water tank)
271, 272 water piping
280 first unit
280K, 282K cover
282 second unit
285A to 285D pipe (humidified air supply pipe)
300 vaporization-type humidifying unit (vaporization-type humidifier)
300F air suction fan
400 mist-type humidifying unit (mist-type humidifier)
401 first mist unit
402 second mist unit
404 first piping (first mist supply pipe)
405 second piping (second mist supply pipe)
P subdivided body
S sheet
W1 first web
W2 second web

The invention claimed is:

1. A sheet manufacturing apparatus comprising:
a raw material cut unit that cuts a raw material containing fibers;
a defibration unit that defibrates the raw material cut by raw material cut unit, in a gas atmosphere;
a web former on which defibrated substances obtained through a defibrating process performed by the defibration unit are accumulated and that forms a web;
a sheet former that forms a sheet of the web;
a vaporization-type humidifier that humidifies an inside of the raw material cut unit; and
a mist-type humidifier that humidifies the web that is formed by the web former.

2. The sheet manufacturing apparatus according to claim 1, further comprising:
an accumulation unit that accumulates the defibrated substances on the web former,
wherein the vaporization-type humidifier humidifies an inside of the accumulation unit.

3. The sheet manufacturing apparatus according to claim 1, further comprising:
a drum portion that sieves the defibrated substances, and
a separation unit that has a separation belt, on which the defibrated substances that have been sieved are accumulated, and separates matter to be removed, which is not used in the sheet, from the defibrated substances,
wherein the vaporization-type humidifier humidifies an inside of the drum portion, and
wherein the mist-type humidifier humidifies accumulated substances accumulated on the separation belt.

4. The sheet manufacturing apparatus according to claim 3, further comprising:
a dust collecting unit that traps the matter to be removed, which has been separated by the separation unit, wherein air having passes through the defibration unit, the separation unit, and the dust collecting unit, in this order is introduced as humidifying target air to the vaporization-type humidifier.

5. The sheet manufacturing apparatus according to claim 3, further comprising:

a division unit that divides the accumulated substances accumulated on the separation belt and includes a pipe in which the accumulated substances which have been divided are transported, wherein the vaporization-type humidifier humidifies an inside of the pipe.

6. The sheet manufacturing apparatus according to claim 5, further comprising:

a mixer that mixes a resin and defibrated substances that configure a subdivided body divided by the division unit, wherein the web former accumulates mixtures mixed by the mixer and forms a web.

7. The sheet manufacturing apparatus according to claim 1, further comprising:

a cutter that cuts the sheet formed by the sheet former, wherein the vaporization-type humidifier humidifies the web that is conveyed from the web former, the sheet to be cut, and the sheet that has been cut.

8. The sheet manufacturing apparatus according to claim 1, further comprising:

a water tank that stores water, wherein water is supplied from the water tank to the vaporization-type humidifier and the mist-type humidifier.

9. The sheet manufacturing apparatus according to claim 8, further comprising:

a control unit that controls water supply to the vaporization-type humidifier and the mist-type humidifier, wherein the control unit controls, as a water supply control, water supply to the water tank at a time of starting up and water supply to each humidifier from the water tank such that an amount of water equal to or larger than a predetermined amount is stored in the vaporization-type humidifier and the mist-type humidifier in a time from the starting up to an operation stop.

10. The sheet manufacturing apparatus according to claim 9, wherein the control unit controls, as a water discharge control at a time of an apparatus stop, water discharge to the water tank from the vaporization-type humidifier and the mist-type humidifier, and water discharge from the water tank.

* * * * *